US006779880B1

(12) United States Patent
Kulpa et al.

(10) Patent No.: US 6,779,880 B1
(45) Date of Patent: Aug. 24, 2004

(54) INSERTION/EXTRACTION MECHANISM FOR AN INK CARTRIDGE

(75) Inventors: Walter J. Kulpa, Trumbull, CT (US); Edward O'Sullivan, Meriden, CT (US)

(73) Assignee: Pitney Bowes Inc., Stamford, CT (US)

( * ) Notice: Subject to any disclaimer, the term of this patent is extended or adjusted under 35 U.S.C. 154(b) by 0 days.

(21) Appl. No.: 10/368,919

(22) Filed: Feb. 19, 2003

(51) Int. Cl.[7] ..... B41J 2/175; B41J 29/13

(52) U.S. Cl. ..... 347/86; 347/108; 222/88; 222/325

(58) Field of Search ..... 347/37, 49, 86, 347/87, 108; 215/325, 328; 222/88, 325

(56) References Cited

U.S. PATENT DOCUMENTS 5,250,957 A * 10/1993 Onozato ..... 347/37
5,427,023 A 6/1995 Privin
5,798,777 A 8/1998 Yoshimura et al.
5,805,181 A * 9/1998 Tanaka et al. ..... 347/29
5,933,173 A * 8/1999 Solero ..... 347/85
6,250,750 B1 6/2001 Miyazawa et al.
6,280,025 B1 8/2001 Beckstrom et al.
6,431,697 B1 8/2002 King et al.

* cited by examiner

*Primary Examiner*—Anh T. N. Vo
(74) *Attorney, Agent, or Firm*—Brian A. Lemm; Angelo N. Chaclas

(57) ABSTRACT

An ink cartridge insertion/extraction mechanism includes a cover pivotally mounted to the housing of the ink cartridge holder. A pair of links are pivotally mounted to the cover and extend into the ink cartridge holder. The bottom of each link is provided with a boss that extends into the ink cartridge holder that contacts the bottom of ink cartridge. As the cover is rotated closed, a pushing rib on the cover contacts the top of the ink cartridge and pushes the ink cartridge further into the holder, causing the needles to puncture the septum of the ink cartridge. To extract the ink cartridge, the cover is rotated from the closed position to the open position, lifting the links until the bosses at the bottom end contact the bottom of the ink cartridge and lift the ink cartridge off of the needles.

22 Claims, 4 Drawing Sheets

INSERTION/EXTRACTION MECHANISM FOR AN INK CARTRIDGE

FIELD OF THE INVENTION

This invention relates generally to the field of ink jet printing, and more particularly to a receiving assembly for inserting and removing a disposable ink cartridge.

BACKGROUND OF THE INVENTION

Ink jet printing mechanisms are well known and have been adapted to a variety of applications and devices, including, for example, office printers, point of sale devices, and mailing machines. Generally, ink jet printing mechanisms include a print head that ejects a series of ink drops onto paper or other medium, until a desired image is achieved. A reservoir of ink keeps the print head supplied with ink.

Typically, a mailing machine utilizes an ink jet printing mechanism in conjunction with a postage metering system included in the mailing machine. Postage metering systems store and dispense postage. Print quality, therefore, becomes more significant in that the ink jet printer must operate reliably to prevent the operator from experiencing loss of postal funds (money) due to a postage indicia being unreadable. Therefore, proper delivery of ink from the ink cartridge to the print head has increased importance. Delivery of the ink can be facilitated by proper installation of an ink cartridge.

In many applications it is desirable to have a user replaceable ink cartridge for providing the reservoir of ink. In this manner, when one supply of ink has been exhausted, an empty ink cartridge may be replaced with a new ink cartridge to replenish the ink supply.

An ink cartridge should be easily inserted into and removed from the ink jet printing mechanism. Preferably, even an inexperienced operator should find the process intuitive and the process should require minimal physical effort. Due to the location of an ink cartridge within a mailing machine, insertion and extraction of an ink cartridge can sometimes be difficult for some operators.

Some ink cartridges include a septum that is pierced with a needle to access a supply of ink within the cartridge. For safety reasons, a blunt needle is utilized to pierce the septum of the ink cartridge. The use of a blunt needle can result in a higher than desirable force to perform the piercing operation. In addition, incorporation of an ink jet printing mechanism within a mailing machine may limit access to the location of insertion, thereby adding to the difficulty of supplying the force required to puncture the septum with the blunt needles. Extraction of an empty ink cartridge may also be difficult if the location of the ink cartridge limits access to it. Furthermore, the needle to septum frictional force can also add to the difficulty of extraction of an empty ink cartridge.

Therefore, there is a need for an uncomplicated insertion/extraction assembly to insert/extract an ink cartridge that is intuitive to a user, is easy to utilize and does not require an inordinate amount of physical force.

SUMMARY OF THE INVENTION

The present invention alleviates the problems associated with the prior art and provides an ink cartridge receiving assembly that includes an insertion/extraction mechanism for an ink cartridge that is easy to use and does not require an inordinate amount of physical force to insert or extract an ink cartridge. Additionally, the insertion/extraction mechanism comprises a minimal number of parts, thereby decreasing production and assembly costs.

In accordance with the present invention, an ink cartridge insertion/extraction mechanism includes a cover pivotally mounted to the housing of an ink cartridge holder. The cover is preferably provided with a pushing rib that extends across the width of the cover. The mechanism is also provided with a pair of links that are pivotally mounted to the cover and extend into the ink cartridge holder. Each link is guided in a slot in the side of the ink cartridge holder. The bottom of each link is provided with a boss that extends into the ink cartridge holder.

When the cover is in an open position, an ink cartridge can be partially inserted into the holder. The pivot point of the links is located behind a center point of the pivot point of the cover, thereby preventing the cover from closing on an operator's hand if the operator pushes the ink cartridge into the holder. The bottom of the ink cartridge is supported by the bosses on the bottom of each link, such that the septum of the ink cartridge are positioned above the needles in the holder. As the cover is rotated closed, the pushing rib contacts the top of the ink cartridge and pushes the ink cartridge further into the holder, causing the needles to puncture the septum of the ink cartridge. The location of the rib on the cover with respect to the pivot point of the cover provides a mechanical advantage to assist in pushing the needles into the septum of the ink cartridge. Preferably, the cover is provided with a latch to secure the cover in the closed position. To extract the ink cartridge, the cover is rotated from the closed position to the open position. As the cover rotates about its pivot point, the links are lifted until the bosses at the bottom end contact the bottom of the ink cartridge. When the bosses have contacted the bottom of the ink cartridge, the ink cartridge is lifted off of the needles by further rotation of the cover. The mechanical advantage provided by the cover/pushing rib/links of the present invention facilitate removal or insertion of an ink cartridge and significantly reduce the amount of force required by an operator to insert or remove the ink cartridge.

Therefore it should now be apparent that the invention substantially achieves all the above aspects and advantages. Additional aspects and advantages of the invention will set forth in the description that follows, and in part will be obvious from the description, or may be learned by practice of the invention. Various features and embodiments are further described in the following figures, descriptions and claims.

DESCRIPTION OF THE DRAWINGS

The accompanying drawings illustrate presently preferred embodiments of the invention, and together with the general description given above and the detailed description given below, serve to explain the principles of the invention. As shown throughout the drawings, like reference numerals designate like or corresponding parts.

DETAILED DESCRIPTION OF THE PRESENT INVENTION

Figure 1:
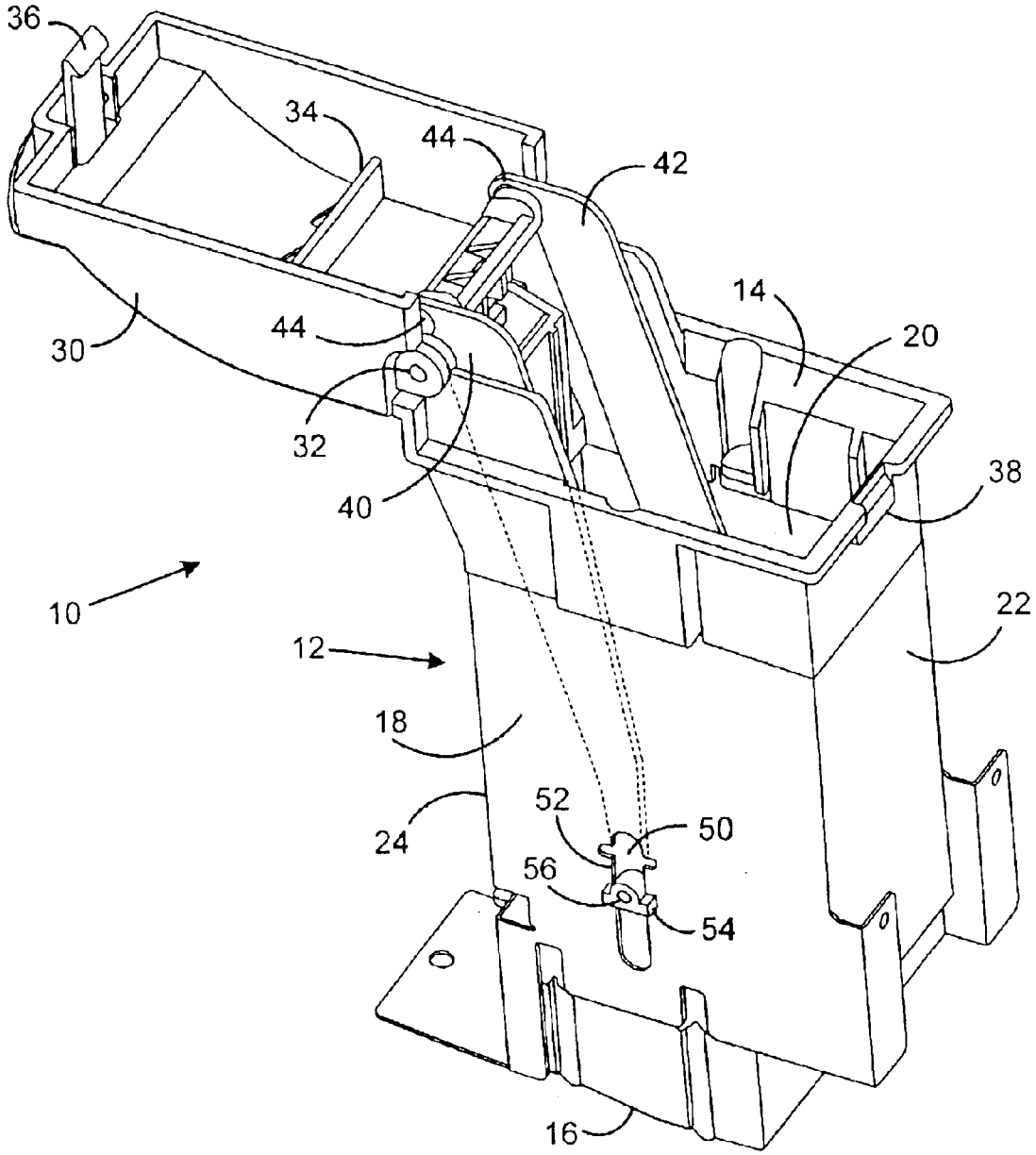
FIG. 1 illustrates an overall view of an ink cartridge insertion/extraction mechanism according to the present invention.

In describing the present invention, reference is made to the drawings, wherein there is seen in FIG. 1 an overall view of an ink cartridge receiving assembly 10 including an insertion/extraction mechanism according to the present invention. Receiving assembly 10 includes an ink cartridge holder 12 having an open end 14 and a closed end 16. The holder 12 includes a pair of side walls 18, 20, a front wall 22 and a rear wall 24 that form a cavity into which an ink cartridge (not shown) can be inserted. A cover 30 is rotatively mounted to the holder 12 at a pivot point 32 located near the top of the rear wall 24. Cover 30 includes a rib 34 that projects from the cover 30 and preferably spans the width of cover 30. Alternatively, rib 34 could be any type of projection that extends out from the cover 34. Cover 30 also preferably includes a latch device 36 that mates with a corresponding latch clasp 38 when the cover 30 is in a closed position as further described below.

According to the present invention, the receiving assembly 10 includes an insertion/extraction mechanism comprising a pair of links 40, 42. Links 40, 42 are preferably formed of a moderate tensile strength polymeric material. Links 40, 42 are rotatively mounted to the cover 30 at a pivot point 44. The pivot point 44 is preferably located behind the center point of pivot point 32, i.e., further from the front wall 22. Links 40, 42 extend into the cavity formed by walls 18, 20, 22 and 24 of holder 12, and are preferably located adjacent to opposite walls, i.e., side walls 18, 20. The bottom end 50 of each link 40, 42 is movably secured in a respective slot 52 formed in the side walls 18, 20, such as, for example, by one or more tabs 54 formed into a cylindrical boss 56 that projects through the slot 52. Slot 52 is vertical with respect to the holder 12 and permits movement of the bottom end 50 of each link 40, 42 in only a vertical direction. The bottom end 50 of each link 40, 42 includes a portion, such as, for example, the cylindrical boss 56, that extends laterally a small distance into the cavity formed by the walls 18, 20, 22, 24. The boss 56 on each link 40, 42 must extend a sufficient amount into the cavity formed by the walls 18, 20, 22, 24 such that an ink cartridge (not shown) placed in the cavity will rest on each boss 56. Alternatively, the bosses 56 can be replaced by a single piece that extends completely across the holder 12, i.e., from side wall 18 to side wall 20, such that the link 40 and link 44 are connected together.

Figure 2:
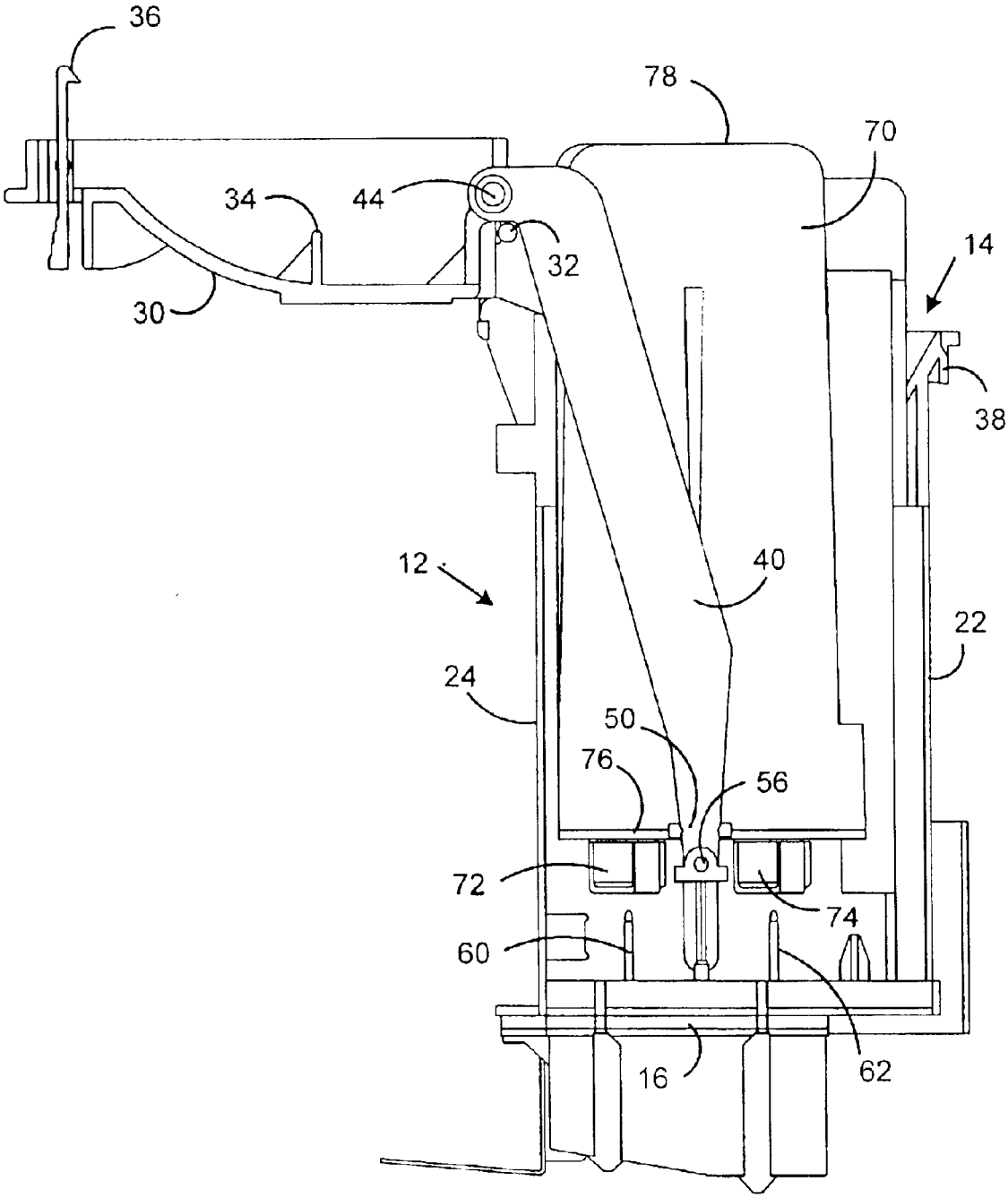
FIG. 2 illustrates a side view of the ink cartridge insertion/extraction mechanism according to the present invention in an open position with the side wall removed.

Referring now to FIG. 2, there is illustrated a side view of the receiving assembly 10 with the side wall 18 and the side edge of the cover 30 removed. The cover 30 is in an open position and an ink cartridge 70 has been placed into the open end 14 of the holder 12. Ink cartridge 70 includes one or more septum 72, 74, which must be pierced to access the ink supply within the ink cartridge 70. As illustrated in FIG. 2, a pair of blunt needles 60, 62 are secured to the closed end 16 of the holder 12, positioned such that the needles 60, 62 will each pierce a corresponding septum 72, 74 on the ink cartridge 70 when the ink cartridge 70 is lowered into the holder 12. The ink cartridge 70 is supported by the bottom 76 of the ink cartridge 70 resting on the top of each boss 56 that extends into the cavity of holder 12. Preferably, the top 78 of ink cartridge 70 extends above the holder 12 such that it can be easily grasped by an operator for removal or placement into the holder 12.

As previously described, the pivot point 44 is preferably located behind the center point of pivot point 32; therefore, any force provided on the ink cartridge 70 in a downward direction will not cause the cover 30 to close on the operator's hand. Specifically, the pivot point 44 and boss 56 are located on opposite sides of pivot point 32. Any force provided by an operator on the ink cartridge 70 will be in a vertically downward force transmitted to the boss 56. If the pivot point 44 was positioned on the same side of the pivot point 32 as the boss 56, this vertically downward force would cause the cover 30 to rotate to a closed position and hit the operator's hand. Since, according to the present invention, the pivot point 44 and boss 56 are positioned on opposite sides of the pivot point 32, the over 30 will not close on the operator's hand. Since both ends of the links 40, 2 are pivotal in nature, they cannot transmit a rotational moment to the cover 30 to cause it to close. The ends of the links 40, 42 can only transmit a force vector to the cover 30. Since the bottom end 50 of each link 40, 42 is constrained to move vertically in slot 52, the force vector is also constrained to a vertical orientation. Positioning of the pivot point 44 on the opposite side of the pivot point 32 as the boss 56 causes the vertical force vector to open rather than close the cover 30.

Figure 3:
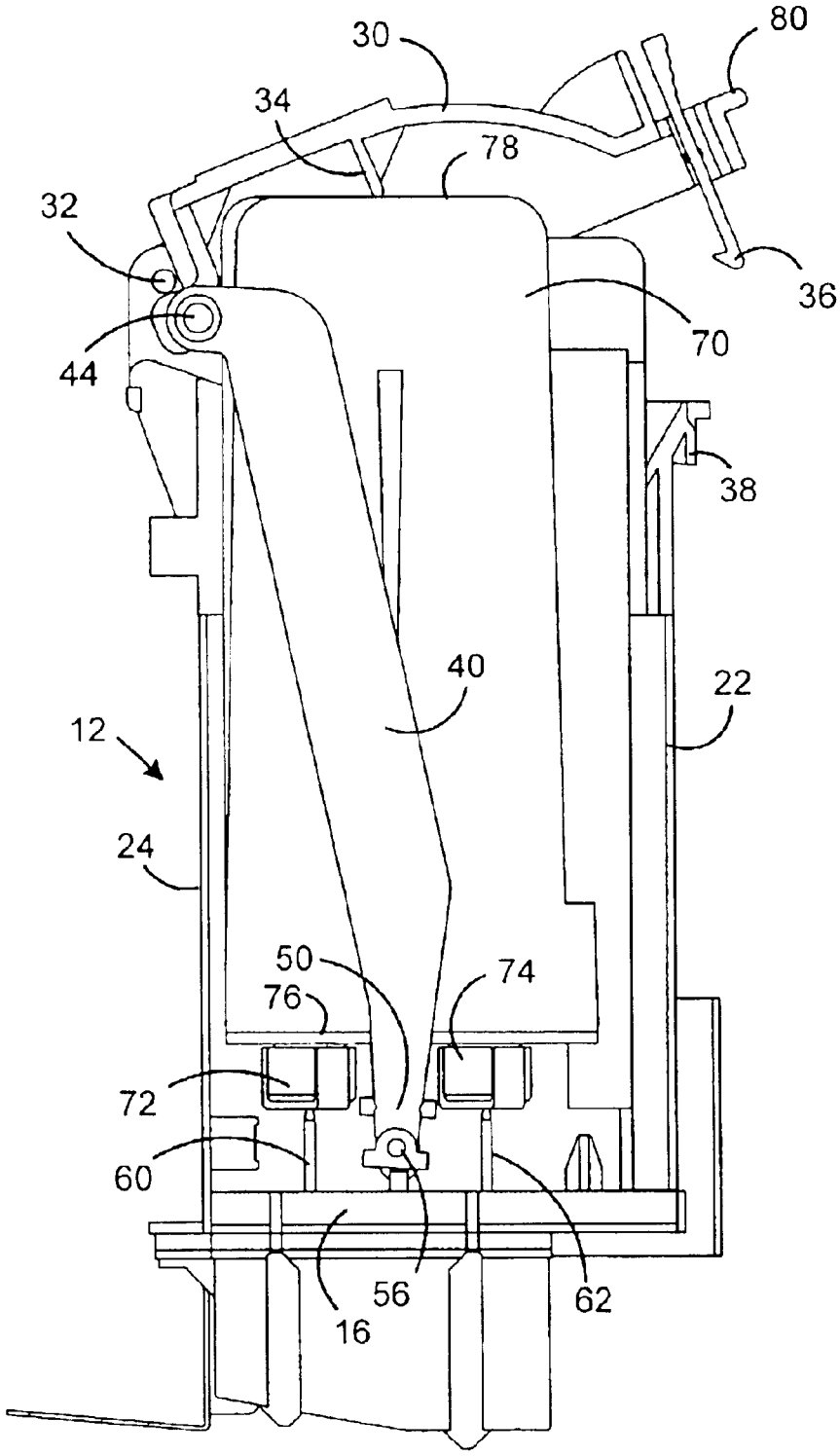
FIG. 3 illustrates the ink cartridge insertion/extraction mechanism of FIG. 2 during an insertion of an ink cartridge.

Referring now to FIG. 3, there is illustrated the ink cartridge 70 being inserted into the holder 12 of the receiving assembly 10 according to the present invention. The cover 30 has been rotated (in a clock-wise direction as illustrated in FIG. 3) about the pivot point 32 towards a closed position such that the rib 34 contacts the top 78 of the ink cartridge 70, thereby pushing the ink cartridge 70 further into the holder 12. The location of the rib 34 with respect to the pivot point 32 of the cover 30 provides a mechanical advantage to assist in pushing the ink cartridge 70 into the holder such that the needles 60, 62 can pierce the septum 72, 74. For example, locating the rib 34 approximately one-third of the distance from the pivot point 32 to the handle 80 at the end of the cover 30 provides a three-to-one mechanical advantage. This allows an operator to easily apply the force necessary for the needles 60, 62 to pierce the septum 72, 74.

As further illustrated in FIG. 3, once the ink cartridge 70 has been lowered some distance into the holder 12, the needles 60, 62 will make contact with the septum 72, 74. When this occurs, further rotation of the handle 30 will cause each boss 56 to separate from the bottom 76 of the ink cartridge 70 and the ink cartridge 70 will be supported by the blunt needles 60, 62 making contact with the septum 72, 74. Note also that the pivot point 44 of the links 40, 42 has rotated over the center point of the pivot point 32 and is now located slightly in front of the center point of the pivot point 32.

Figure 4:
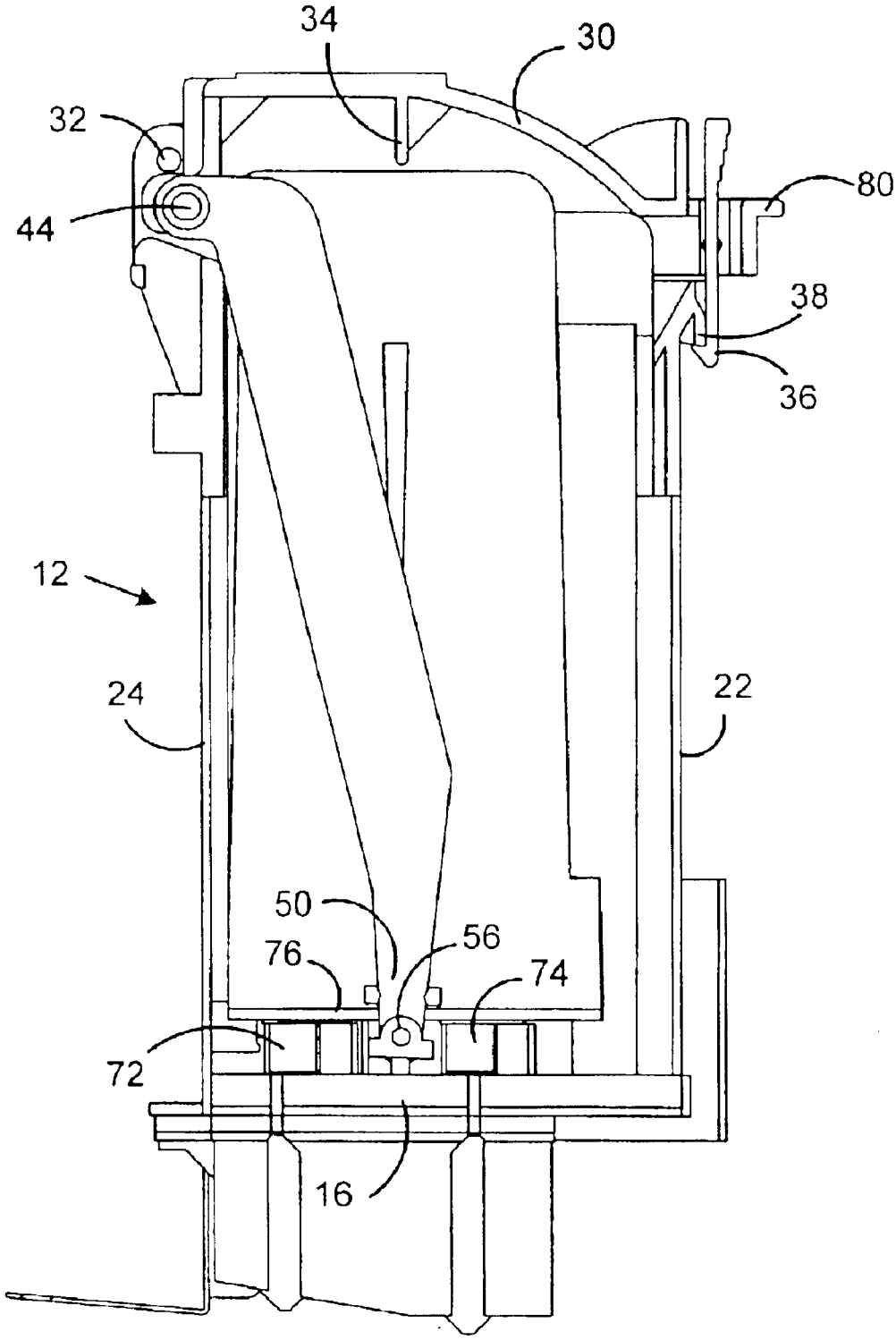
FIG. 4 illustrates an ink cartridge fully inserted into the ink cartridge insertion/extraction mechanism of FIG. 2.

Referring now to FIG. 4, there is illustrated the ink cartridge 70 fully inserted into the holder 12 and the handle 30 in a closed position. As the handle 30 is further rotated closed (from the position as illustrated in FIG. 3), the needles 60, 62 will pierce the septum 72, 74, thereby allowing access to the ink within the ink cartridge 70. When handle 30 is in the fully closed position, the latch device 36 couples with the latch clasp 38, thereby securing the cover 30 in the closed position. The bosses 56 are located in a gap formed by the bottom 76 of the ink cartridge 70, the closed end 16 of the holder 12, and the septum 72, 74.

The extraction of the ink tank 70 from the holder 12 is basically a reversal of the steps described above. The latch device 36 is uncoupled from the latch clasp 38 and the cover 30 rotated about pivot point 32 towards the open position. As the cover is rotated (counter-clockwise as illustrated in FIG. 4), the links 40, 42 will be lifted, causing the bosses 56 to move in a vertical direction, guided by the slots 52, and contact the bottom 76 of the ink cartridge 70. The location of the pivot point 44 of the links 40, 42 with respect to the handle 80 of the cover 30 provides a mechanical advantage to assist in overcoming the frictional force of the needles 60, 62 and the holder 12 on the ink cartridge 70 when extracting the ink cartridge 70 from the holder 12. For example, by locating the pivot point 44 approximately one-fifteenth of the distance to the handle 80 at the end of the cover 30, the operator effort required to extract the ink cartridge 70 from the holder 12 is minimal. This allows an operator to easily apply the force necessary to overcome the friction between the needles 60, 62 and the septum 72, 74, as well as any friction between the ink cartridge 70 and the walls 18, 20, 22, 24 of the holder 12.

When the handle 30 has been fully rotated to the open position, as illustrated in FIG. 2, the boss 56 of the links 40, 42 will have vertically lifted the ink cartridge in the holder 12 such that the top 78 of ink cartridge 70 extends above the holder 12, thereby allowing the ink cartridge 70 to be easily grasped by an operator for removal from the holder 12. As previously described, the pivot point 44 will now preferably be located behind the center point of pivot point 32; therefore, any force provided on the ink cartridge 70 in a downward direction will not cause the cover 30 to close on the operator's hand.

Thus, according to the present invention, a receiving assembly 10 including an insertion/extraction mechanism for an ink cartridge 70 is provided that is easy to use and does not require an inordinate amount of physical force to insert or extract the ink cartridge 70. Additionally, the insertion/extraction mechanism comprises a minimal number of parts, including the cover 30 and links 40, 42, thereby decreasing production and assembly costs.

While preferred embodiments of the invention have been described and illustrated above, it should be understood that these are exemplary of the invention and are not to be considered as limiting. Additions, deletions, substitutions, and other modifications can be made without departing from the spirit or scope of the present invention. For example, components of the present invention can be formed from plastic, steel;, aluminum, alloy or other material. Accordingly, the invention is not to be considered as limited by the foregoing description but is only limited by the scope of the appended claims.

What is claimed is:

1. A receiving assembly for an ink cartridge, the ink cartridge having one or more septum sealing ink within the ink cartridge, the receiving assembly comprising:

a holder defining a cavity for receiving the ink cartridge;

one or more needles extending into the cavity, each needle corresponding with a respective septum of the ink cartridge;

a cover rotatively mounted to the holder at a first pivot point; and a plurality of links each having a first end and a second end, each of the plurality of links being rotatively mounted at the first end to the cover at a second pivot point, the second pivot point being located on an opposite side of a center point of the first pivot point as the second end of the plurality of links when the cover is in an open position and on a same side of the center point of the first pivot point as the second end of the plurality of links when the cover is in a closed position, the second end of the plurality of links extending into the cavity and including a portion projecting laterally into the cavity, wherein rotation of the cover from the open position to the closed position causes a portion of the cover to engage a top portion of the ink cartridge and push the ink cartridge into the holder such that the one or more needles pierce a respective septum, and rotation of the cover from the closed position to the open position causes the portion projecting laterally into the cavity of the second end of the plurality of links to engage a bottom portion of the ink cartridge and lift the ink cartridge off of the one or more needles.

2. The receiving assembly of claim 1, wherein the cover further comprises:

a portion projecting from the cover, wherein the portion projecting from the cover engages the top portion of the ink cartridge when the cover is rotated from the open position to the closed position.

3. The receiving assembly of claim 2, wherein the portion projecting from the cover is a rib.

4. The receiving assembly of claim 1, wherein the second end of each of the links is movably secured to the holder through a vertical slot in a respective wall of the holder.

5. The receiving assembly of claim 1, wherein the cover further comprises:

a latching device, the latching device adapted to couple with a latch clasp located on the holder to secure the cover in the closed position.

6. The receiving assembly of claim 1, wherein the plurality of links are formed of polymeric material.

7. The receiving assembly of claim 1, wherein the plurality of links includes two links located adjacent to opposite walls of the holder.

8. The receiving assembly of claim 7, wherein the portion of the second end of the two links projecting laterally into the cavity is a single piece coupling the two links together.

9. The receiving assembly of claim 1, wherein when the cover is in the open position, an ink cartridge inserted into the holder is supported by the portion of the second end of the plurality of links projecting laterally into the cavity such that a top portion of the ink cartridge is above the holder.

10. The receiving assembly of claim 1, wherein the portion of the second end of the plurality of links projecting laterally into the cavity is a cylindrical boss.

11. A holder for a replaceable ink cartridge, the holder comprising:

an open end for receiving the replaceable ink cartridge;

a closed end opposite the open end, the closed end including at least one needle extending into the holder;

a cover rotatively mounted to the open end at a first pivot point, the cover including a rib; and a first link and a second link each having a first end and a second end, each of the first and second links being rotatively mounted at the first end to the cover at a second pivot point, the second pivot point being on an opposite side of the first pivot point as the second ends of the first and second links when the cover is in a first position, the second ends extending from the open end of the holder towards the closed end of the holder, the second ends including a portion projecting laterally into the holder, wherein rotation of the cover from the first position to a second position causes the rib of the cover to engage a top portion of the replaceable ink cartridge and push the replaceable ink cartridge into the holder such the that the at least one needle pierces a respective septum of the replaceable ink cartridge, and rotation of the cover from the second position to the first position causes the portion projecting laterally into the holder of the second end of each of the first and second links to engage a bottom portion of the replaceable ink cartridge and lift the replaceable ink cartridge off of the at least one needle.

12. The holder of claim 11, wherein when the cover is in the first position, a replaceable ink cartridge inserted into the holder is supported by the portion of the second end of the first and second links projecting laterally into the holder such that a top portion of the replaceable ink cartridge is above the holder.

13. The holder of claim 11, further comprising:

a first slot in a first wall of the holder, the second end of the first link being movably secured in the first slot; and a second slot in a second wall of the holder, the second wall being opposite the first wall, the second end of the second link being movably secured in the second slot.

14. A mailing machine comprising:

a receiving assembly for an ink cartridge, the ink cartridge having one or more septum sealing ink within the ink cartridge, the receiving assembly comprising:

a holder defining a cavity for receiving the ink cartridge;

one or more needles extending into the cavity, each needle corresponding with a respective septum of the ink cartridge;

a cover rotatively mounted to the holder at a first pivot point; and a plurality of links each having a first end and a second end, each of the plurality of links being rotatively mounted at the first end to the cover at a second pivot point, the second pivot point being located on an opposite side of a center point of the first pivot point as the second end of the plurality of links when the cover is in an open position and on a same side of the center point of the first pivot point as the second end of the plurality of links when the cover is in a closed position, the second end of the plurality of links extending into the cavity and including a portion projecting laterally into the cavity, wherein rotation of the cover from the open position to the closed position causes a portion of the cover to engage a top portion of the ink cartridge and push the ink cartridge into the holder such that the one or more needles pierce a respective septum, and rotation of the cover from the closed position to the open position causes the portion projecting laterally into the cavity of the second end of the plurality of links to engage a bottom portion of the ink cartridge and lift the ink cartridge off of the one or more needles.

15. The mailing machine of claim 14, wherein the receiving assembly cover further comprises:

a portion projecting from the cover, wherein the portion projecting from the cover engages the top portion of the ink cartridge when the cover is rotated from the open position to the closed position.

16. The mailing machine of claim 15, wherein the portion projecting from the cover is a rib.

17. The mailing machine of claim 14, wherein the second end of each of the links is movably secured to the holder through a vertical slot in a respective wall of the holder.

18. The mailing machine of claim 14, wherein the receiving assembly cover further comprises:

a latching device, the latching device adapted to couple with a latch clasp located on the holder to secure the cover in the closed position.

19. The mailing machine of claim 14, wherein the plurality of links are formed of polymeric material.

20. The mailing machine of claim 14, wherein the plurality of links includes two links located adjacent to opposite walls of the holder.

21. The mailing machine of claim 20, wherein the portion of the second end of the two links projecting laterally into the cavity is a single piece coupling the two links together.

22. The mailing machine of claim 14, wherein when the receiving assembly cover is in the open position, an ink cartridge inserted into the holder is supported by the portion of the second end of the plurality of links projecting laterally into the cavity such that a top portion of the ink cartridge is above the holder.

* * * * *